United States Patent [19]

Cressy

[11] Patent Number: 4,583,671

[45] Date of Patent: Apr. 22, 1986

[54] VARIABLE FIT FASTENER ATTACHMENT

[76] Inventor: Clifford E. Cressy, 9224 Beech Ave., Munster, Ind. 46321

[21] Appl. No.: 609,231

[22] Filed: May 11, 1984

[51] Int. Cl.[4] ..... B25C 1/02

[52] U.S. Cl. ..... 227/144; 81/421

[58] Field of Search ..... 29/227, 268; 81/185, 81/421, 423; 227/144, 156

[56] References Cited

U.S. PATENT DOCUMENTS

| | | | |
|---|---|---|---|
| D. 207,457 | 4/1967 | Cressy | D54/13 |
| 1,263,412 | 4/1918 | Haynes | 81/421 X |
| 2,404,224 | 7/1946 | Fink | 81/421 X |
| 2,474,940 | 7/1949 | Hansen | 81/423 X |
| 2,766,649 | 10/1956 | Labry, Jr. | 81/423 X |
| 3,091,770 | 6/1963 | McMurray | 227/144 |
| 3,517,874 | 6/1970 | Cressy | 227/144 |

OTHER PUBLICATIONS

*American Machinist,* May 11, 1944, p. 89, "Soft Plier Jaws".

*Primary Examiner*—Paul A. Bell

*Attorney, Agent, or Firm*—Dressler, Goldsmith, Shore, Sutker & Milnamow, Ltd.

[57] ABSTRACT

A variable fit fastener-applying attachment is disclosed which is particularly suited for use with a pair of locking vise type pliers. The attachment comprises a pair of first and second clamp members which are configured for respective mounting on the pliers jaws. The clamp members are configured for applying clamping pressure to a fastener assembly positioned therebetween such that the assembly is permanently applied to a piece of fabric, plastic, leather, or the like sheet material. In one embodiment of the invention, the variable fit nature of the attachment for mounting on different pairs of pliers having differently sized jaws is achieved by the provision of a pair of flexible gripping fins on each of the clamp members. In alternate embodiments, each clamp member is configured to provide resiliently flexible inward and outward movement of its sidewall portions to achieve the desired gripping engagement of the clamp members with the pliers jaws.

13 Claims, 15 Drawing Figures

VARIABLE FIT FASTENER ATTACHMENT

TECHNICAL FIELD

The present invention relates generally to a fastener-applying attachment adapted to be fitted to a pair of pliers for applying clamping pressure to a fastener assembly, and more particularly to a fastener clamp attachment which is configured for variable fit to permit use on different pairs of pliers having differently sized jaws.

BACKGROUND OF THE INVENTION

U.S. Pat. No. 3,517,874 discloses a fastener attachment, comprising a pair of clamp members, which is particularly adapted for use with a pair of locking vise type pliers to permit very convenient application of fastener assemblies to cloth, leather, flexible plastic, rubberized fabric, and like sheet materials. The fastener assembly may be in the nature of a snap, an eyelet, a rivet, or a similar type of assembly including a pair of elements which are joined together in sandwich-like relation with the piece of material to which the assembly is being applied.

Use of the fastener attachment of this patent, particularly in conjunction with a vise type pliers, permits application of very substantial clamping pressure to the fastener assembly. In this manner, a suitable hole is automatically punched in the material to which the fastener elements are being applied, with one of the elements usually being swaged or otherwise deformed to permanently hold the fastener elements together in sandwich-like relation with the material. The fastener attachment for the pliers can be readily provided in various configurations to permit the application of a very wide variety of the different fastener assemblies, and because of the ease of use provided by the attachment, an almost limitless number of applications present themselves. The removable fitment of the clamp members of the attachment to a pair of vise type pliers is a particularly desirable feature of the device since it avoids the need for relatively expensive specialized fastener-applying tools, with the vise type pliers otherwise being a handy and useful tool in its own right.

The construction of the fastener attachment of the above patent is desirably straightforward for economical manufacture and affordable use. Each one of the clamp members of the attachment defines a generally rectangular cavity for receiving a respective one of the jaws of a pair of vise type pliers. The clamp members may comprise suitably resilient plastic, nylon, polycarbonate, or metal. The clamp members are usually configured to exhibit sufficient flexibility so as to permit secure, yet releasable, fitment to the pliers jaws. Thus, the clamp members can be readily fitted in generally opposing relation on the pliers jaws, with the elements of the fastener assembly positioned therebetween on respective sides of material to which the assembly is being applied. The pliers are then operated, and in a matter of seconds the fastener assembly is permanently affixed to the material.

While the above-described fastener attachment has found widespread consumer acceptance, the manner in which the attachment is fitted to a pair of pliers can in some instances act to limit the versatility of its use. Specifically, it is preferred that the clamp members be mounted on the jaws of the pliers in a secure manner, and accordingly the clamp members of such fastener attachments have in the past been suitably dimensioned to provide this secure fitment. However, vise type pliers are readily available having jaws of different sizes and configurations. For example, the pliers may be of the so-called straight jaw type wherein the jaws are each generally rectangular (when viewed in plan). In contrast, vise type pliers are also available which include jaws of a tapered configuration wherein the rear portion of each jaw is wider than it nose or front portion. Because of this difference in size and configuration of the jaws of different pairs of pliers, it has not generally been possible in the past to use the clamp members of a fastener attachment which have been sized for one pair of pliers on a differently sized pair of pliers, thus somewhat limiting the versatility of such an attachment.

Accordingly, it is desirable to provide a fastener applying clamp attachment for a pair of pliers which is configured to accommodate secure yet releasable fitment to different pairs of pliers having differently sized jaws.

SUMMARY OF THE INVENTION

A fastener-applying clamp attachment for a pair of pliers embodying the principles of the present invention is disclosed which is particularly configured to accommodate use with different pliers having differently sized jaws. This desirable result is achieved by configuring the clamp members of the attachment to each include resilient means for grippingly engaging the respective one of the jaws of a pair of pliers. Thus, the desired secure fitment of the clamp members to differently sized jaws is readily achieved.

In accordance with the illustrated embodiments of the present invention, the variable fit fastener attachment comprises a pair of first and second fastener clamp members which are adapted for respective removable fitment to the jaws of a pair of pliers. Each of the clamp members preferably comprises a bottom wall, a front wall, and a pair of laterally spaced sidewalls, with the walls together defining a generally rectangular cavity for receiving a respective one of the jaws of the pliers. Thus, the clamp members are positionable on the jaws of the pliers in generally opposed relation for applying clamping pressure to an associated fastener assembly or other structure positioned therebetween.

To accommodate fitment to differently sized pliers jaws, each of the first and second clamp members includes resilient means for achieving a variable fit. In one embodiment of the invention, the variable fit means comprises a pair of integrally formed, flexible gripping fins which extend longitudinally of and into the cavity of each clamp member from respective lateral sides thereof. The gripping fins preferably extend angularly into the cavity from respective sidewalls of each clamp member, with each gripping fin preferably extending generally from the open end of the cavity to the associated front wall of the clamp member.

Each gripping fin preferably decreases in thickness from its respective sidewall to a free edge thereof to provide each gripping fin with desired resilient flexibility. In the preferred form, the gripping fins are further preferably configured such that the pair of gripping fins of each clamp member taper toward each other from the open end of the rectangular cavity to the front wall of the clamp member. Thus, each clamp member can be readily dimensioned for receiving a relatively large jaw of a pair of pliers, with the resilient flexibility of the gripping fins accommodating such fitment, while at the same time each clamp member is mountable on a pliers jaw of a relatively smaller size wherein the gripping fins grippingly engage the lateral sides of the jaw to securely retain the clamp member in position thereon.

A like variable fit is achieved in alternate embodiments of the invention without the provision of the flexible gripping fins, but rather by configuring each clamp member to permit resilient inward and outward movement of its lateral sidewalls. In one alternate embodiment, the sidewalls of each clamp member are joined to the bottom wall thereof, but are at least partially separated from the front wall of the clamp member. The sidewalls are preferably configured to taper slightly toward each other in a direction away from the bottom wall, with the sidewalls exhibiting sufficient resilient flexibility to accommodate secure fitment of the clamp members to both relatively large and relatively small pliers jaws.

In a further embodiment, like resilient inward and outward movement of the sidewalls of each clamp member is achieved by joining the sidewalls to the front wall of the respective clamp member, with the sidewalls being at least partially separated from the bottom wall of the respective clamp member. In this embodiment, the sidewalls are configured to taper toward each other in a direction away from the front wall, thus providing the desired gripping engagement of differently sized pliers jaws.

Numerous other features and advantages of the present invention will become readily apparent from the following detailed description, the accompanying drawings, and the appended claims.

DETAILED DESCRIPTION

Figure 1:
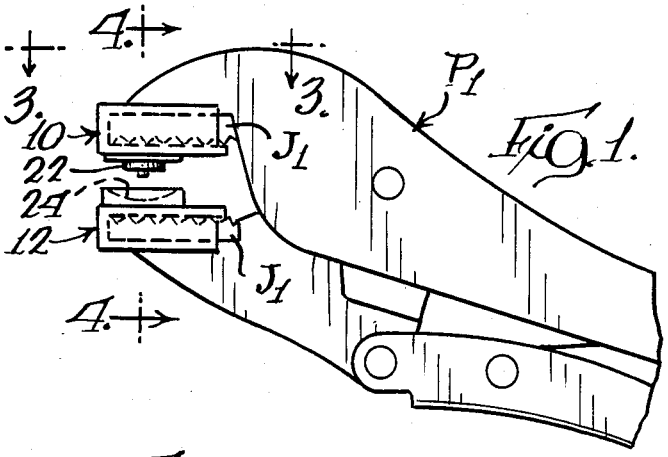
FIG. 1 is a side elevational view of the present fastener attachment shown in position for use on an associated pair of pliers having relatively large, rectangularly-shaped jaws.

While the present invention is susceptible of embodiment of various forms, there is shown in the drawings and will hereinafter be described in presently preferred and alternate embodiments of the invention, with the understanding that the present disclosure is to be considered as an exemplification of the invention, and is not intended to limit the invention to the specific embodiments illustrated.

Figure 2:
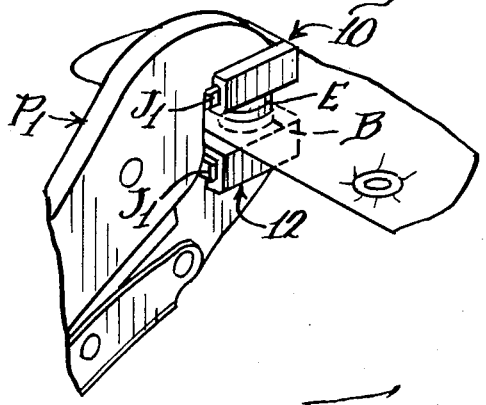
FIG. 2 is a perspective view of the fastener attachment and pliers shown in FIG. 1 being used to apply a fastener assembly.
Figure 3:
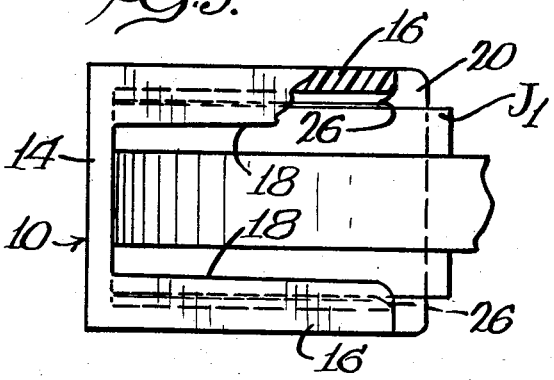
FIG. 3 is a plan view, in partial cutaway, taken generally along lines 3—3 of FIG. 1.

With particular reference first to FIGS. 1–4, therein is illustrated a fastener-applying attachment, comprising a first clamp member 10 and a second clamp member 12, shown mounted for use on an associated pair of locking vise type pliers $P_1$. The first and second clamp members 10 and 12 are adapted to be respectively removably mounted on the jaws $J_1$ of the pliers $P_1$ in generally opposed relation. When mounted to a pair of pliers in this fashion, the clamp members are adapted to apply very substantial clamping pressure to a fastener assembly positioned therebetween. In the illustrated embodiment, the fastener assembly is shown as comprising an eyelet element E which defines an opening in its center, and a button element B including a stem portion which is adapted to extend through the opening in the eyelet. The stem of the button B is swaged or otherwise deformed during application to a piece of material, such as shown in FIG. 2, such that the elements of the fastener assembly are permanently joined together on the piece of material.

The first and second clamp members 10 and 12 are of generally like unitary configuration, and typically are specifically configured in accordance with the type of fastener assembly to be applied. Each of the clamp members preferably comprises a suitable molding of firm yet resilient resinous plastic material such as polypropylene, polycarbonate, nylon or the like, but the clamp members may alternately be formed from metal. Each of the first and second clamp members includes a front wall 14 and a pair of integral laterally spaced sidewalls 16 each of which defines a retaining lip 18 at its free edge. Each retaining lip 18 is preferably relatively thin so as to exhibit resilient flexibility to promote the variable fit of the clamp members.

Each of the clamp members 10 and 12 further includes an integral bottom wall 20 which together with front wall 14 and sidewalls 16 defines a rectangular cavity for receiving a respective one of the jaws of the associated pair of pliers. Thus, the first and second clamp members 10 and 12 are readily removably mountable on the jaws $J_1$ of the pliers $P_1$ such that the bottom walls 20 of the clamp members are in generally opposed relation. For some applications, it can be advantageous to taper the inside surfaces of sidewalls 16 toward each other as shown at 19 in phantom line in FIG. 9 to provide the desired secure fitment of the clamp members 10 and 12 to the pliers jaws.

Figure 4:
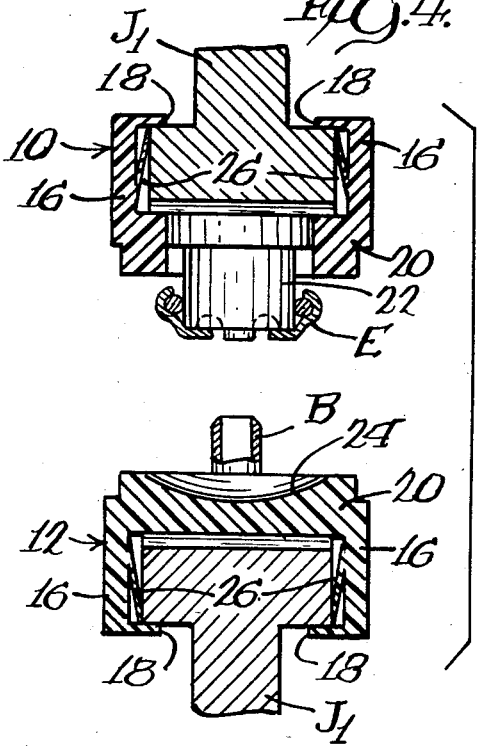
FIG. 4 is a cross-sectional view taken generally along lines 4—4 of FIG. 1 further illustrating the present fastener attachment.

As noted, the exact configuration of the first and second members 10 and 12 is ordinarily selected in accordance with the type of fastener assembly to be applied. Thus, in the illustrated embodiment, first clamp member 10 is shown as including a metallic anvil 22 mounted in and extending through its bottom wall 20. Similarly, second clamp member 12 is illustrated as defining a button-receiving depression 24 in its bottom wall 20. Thus, as best shown in FIG. 4, fastener elements such as eyelet E and button B are respectively positionable on the anvil 22 and the depression 24, with the pliers $P_1$ thereafter operated so that the hollow stem of the button B is deformed within the circular groove defined by the face of anvil 22 to permanently join the fastener eyelet and button elements together in sandwich-like relation about a piece of material. Because of the very great clamping force that can be generated between clamp members 10 and 12, the hollow stem of the button B acts to automatically punch a hole in the piece of material as the fastener assembly is applied thereto.

Figure 8:
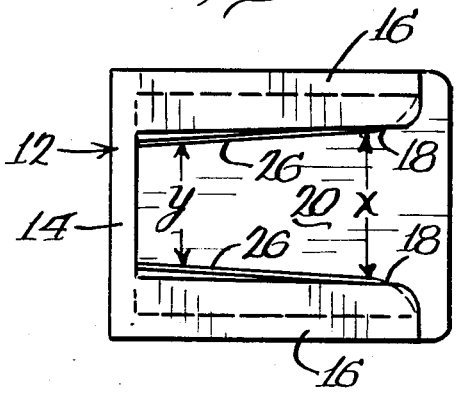
FIG. 8 is a top plan view of one of the clamp members of the present fastener attachment.
Figure 9:
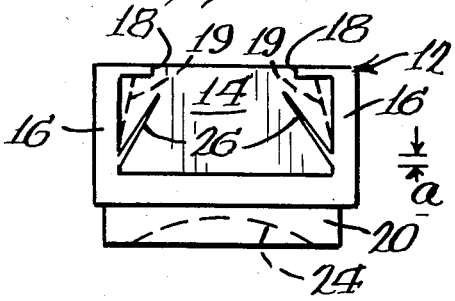
FIG. 9 is an end elevational view of the clamp member of the present attachment shown in FIG. 8.

In accordance with the present invention, each of the first and second clamp members 10 and 12 include means for achieving a variable fit of the clamp members to different pairs of pliers having differently sized jaws. To this end, each of the clamp members includes a pair of resiliently flexible gripping fins 26 which extend into the rectangular cavities of the clamp members from respective laterally opposite sides thereof. As shown in FIGS. 8 and 9 wherein the second clamp member 12 is illustrated, the gripping fins 26 of each clamp member extend generally inwardly of the rectangular cavity of each clamp member from a respective one of the laterally spaced sidewalls 16 generally from the junctions of the sidewalls 16 with the bottom wall 20 of the clamp member. Each gripping fin 26 preferably extends angularly into the rectangular cavity of its respective clamp member, with each fin 26 preferably disposed at an angle on the order of approximately 50 to 60 degrees with respect to the bottom wall 20 of the clamp member.

In order to provide each gripping fin 26 with the desired resilient flexibility, each of the fins preferably decreases in thickness from its respective one of the sidewalls 16 to a free edge thereof. As best shown in FIG. 8, each pair of gripping fins 26 is further preferably configured such that the fins taper toward each other from the open end of the rectangular cavity to the front wall 14 of the clamp member, with the gripping fins 26 each joined to the front wall 14.

The gripping fins 26 are preferably formed integrally with the sidewalls 16 of each clamp member, and thus exhibit the desired resilient flexibility when the clamp members 10 and 12 are fabricated from plastic material or the like. The gripping fins 26 can thereby be provided on a fastener-applying attachment in accordance with the present invention at relatively modest cost, with the versatility of the fastener attachment desirably enhanced.

As noted above, FIGS. 1 to 4 illustrate use of first and second clamp members 10 and 12 on pliers $P_1$ wherein the jaws $J_1$ thereof are of generally rectangular configuration, with each jaw having generally parallel opposite lateral sides. When used on a pair of pliers of this description, the flexibility of the gripping fins 26 permits them to be readily moved toward respective sidewalls 16 so that the fins grippingly engage the laterally opposite sides of the jaws $J_1$, with the retaining lips 18 of the sidewalls 16 retaining the clamp members on the pliers jaws for use in applying a fastener assembly.

Figure 5:
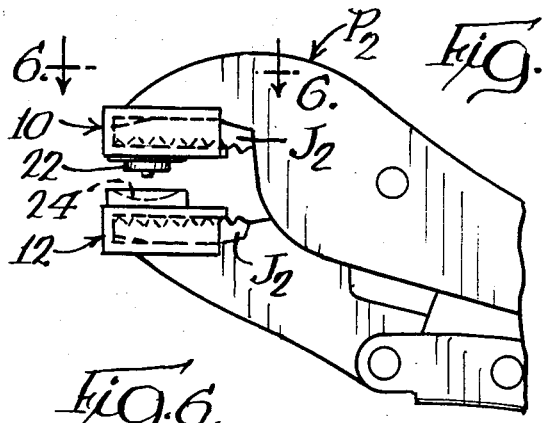
FIG. 5 is a side elevational view similar to FIG. 1 illustrating the present fastener attachment mounted for use on a pair of pliers having relatively small, tapered jaws.
Figure 6:
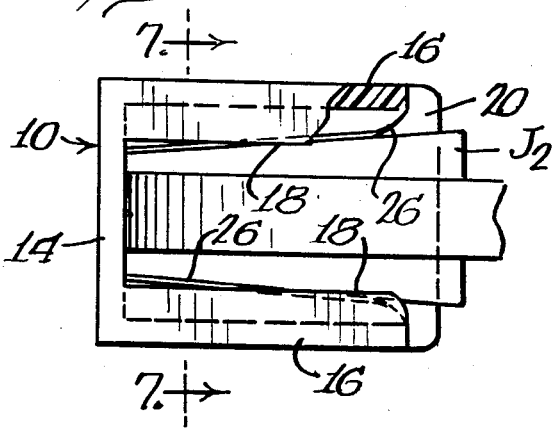
FIG. 6 is a plan view, partially cutaway, taken generally along lines 6—6 of FIG. 5.
Figure 7:
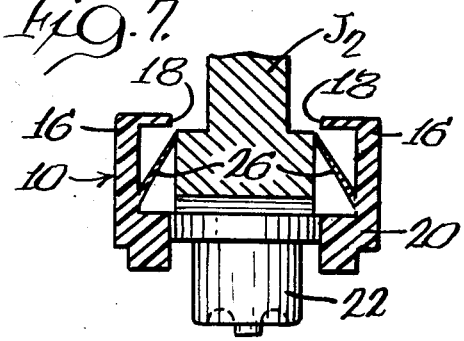
FIG. 7 is a cross-sectional view taken generally along lines 7—7 in FIG. 6.

In contrast, FIGS. 5 to 7 illustrate clamp members 10 and 12 mounted to another pair of pliers $P_2$ having jaws $J_2$ of a tapered configuration. Jaws $J_2$ are illustrated as having curved clamping faces, which is typical of some types of locking vise type pliers. As will be appreciated, provision of the gripping fins 26 desirably acts to firmly maintain the clamp members in position on the tapered jaws $J_2$ even though the jaws $J_2$ are relatively smaller than the jaws $J_1$ of pliers $P_1$. Thus, as best shown in FIG. 7 wherein first clamp member 10 is illustrated, the gripping fins 26 grippingly engage the laterally opposite sides of the pliers jaw $J_2$ to firmly retain the clamp members in position on the pliers for applying fastener assemblies. As will be recognized, the preferred configuration of the gripping fins 26 wherein they taper toward each other particularly facilitates use of the clamp members on a pair of pliers having jaws of a tapered configuration. Even though the retaining lips 18 of the clamp member sidewalls 16 may still engage the jaws of the pair of pliers and to some extent act to retain the clamp members in position thereon, the resilient gripping action of the gripping fins 26 assures that the clamp members are retained in position for convenient and efficient use.

By way of example, a current embodiment of the above-described attachment has been configured for use on straight jaw pliers such as $P_1$ having a jaw width on the order of approximately 0.58–0.62 inches, while also being configured for use on a pair of tapered jaw pliers such as $P_2$ having jaws which taper from a width of approximately 0.50–0.525 inches to a width of approximately 0.410–0.450 inches.

In this current embodiment of the attachment, the width of the rectangular cavity of each clamp member at the junctions of sidewalls 16 with the bottom wall 20 is approximately 0.675 inches, with the distance between retaining lips 18 being approximately 0.495–0.500 inches. The centerline of each gripping fin 26 is disposed at an angle of approximately 55 degrees relative to bottom wall 20, with the spacing between the fins 26 decreasing from approximately 0.480 inches at "x" to approximately 0.410 inches at front wall 14 at "y" (see FIG. 8). Each gripping fin 26 has been provided with a length of approximately 0.205 inches as measured from its respective sidewall 16 to the free edge thereof where the dimension "x" above has been measured. The vertical dimension of each fin 26 is approximately 0.070 inches at the base thereof as indicated at "a" in FIG. 9, with each fin 26 decreasing in thickness to a dimension of approximately 0.005–0.010 inches at the free edge thereof. The base of each fin 26 is preferably spaced above the bottom wall 20 by approximately 0.030 inches.

Figure 10:
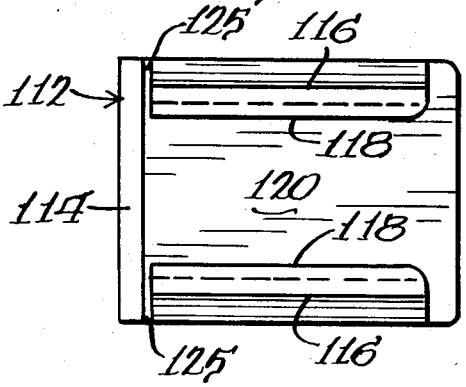
FIG. 10 is a top plan view of one of the clamp members of an alternate embodiment of the present fastener attachment.
Figure 11:
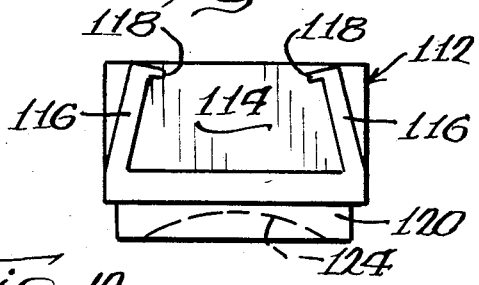
FIG. 11 is an end elevational view of the clamp member of the alternate embodiment shown in FIG. 10.
Figure 12:
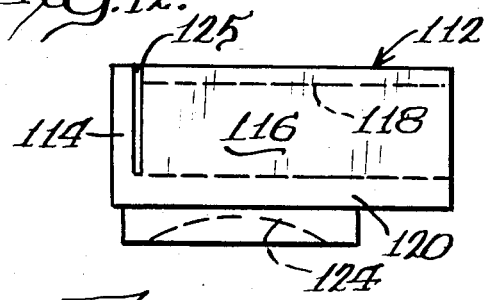
FIG. 12 is a side elevational view of the clamp member shown in FIGS. 10 and 11.

Referring now to FIGS. 10 to 12, therein is illustrated a first alternate embodiment of the present invention. An alternate embodiment of the second clamp member, designated 112, is shown in these figures, with the understanding that a pair of similarly configured coacting clamp members are ordinarily provided for use on a pair of pliers. In this alternate embodiment, the clamp member 112 is configured to permit resilient inward and outward movement of its sidewalls in order to accommodate fitment to different pliers having differently sized jaws.

The clamp member 112 includes a front wall 114, and a pair of integral laterally spaced sidewalls 116 each having a retaining lip 118. The clamp member further includes an integral bottom wall 120 which defines a button-receiving depression 125, with the walls of the clamp member thus defining its jaw-receiving rectangular cavity.

While the sidewalls 116 of the clamp member 112 are integrally joined to the bottom wall 120 thereof, each of the sidewalls 116 is separated from the front wall 114, as indicated at 125. Further, the sidewalls 116 are configured to taper toward each other in a direction away from bottom wall 120. Thus, the sidewalls 116 can move inwardly and outwardly so that they grippingly engage the laterally opposite sides of differently sized jaws of different pairs of pliers.

Notably, the illustrated inwardly tapering configuration of the sidewalls 116 can be readily achieved when the clamp member is suitably formed from plastic material or the like since the sidewalls 116 can be formed in generally parallel relation in an injection mold, with the sidewalls thereafter tending to move toward each other upon removal of the clamp member from the mold as the material cools and cures. Of course, the sidewalls 116 can alternately be initially molded in their inwardly tapering configuration.

Figure 13:
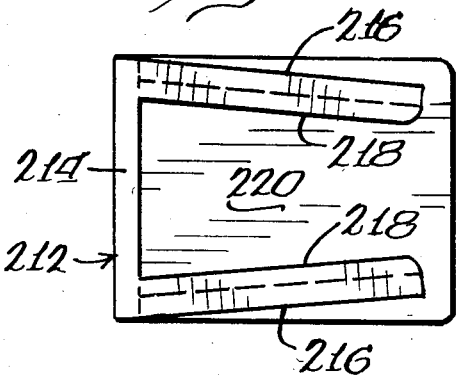
FIG. 13 is a top plan view of one of the clamp members of a further alternate embodiment of the present fastener attachment.
Figure 14:
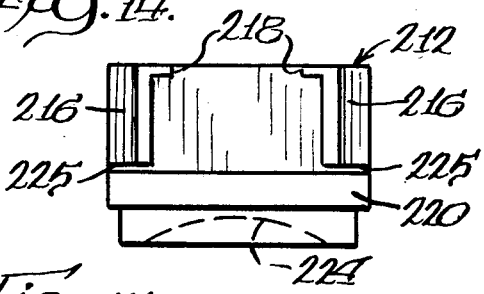
FIG. 14 is an end elevational view of the clamp member shown in FIG. 13.
Figure 15:
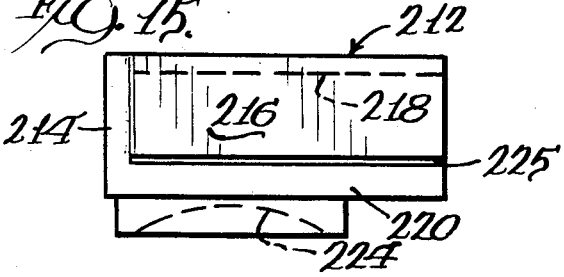
FIG. 15 is a side elevational view of the clamp member shown in FIGS. 13 and 14.

FIGS. 13–15 illustrate a further embodiment of the present invention which, like the embodiment of FIGS. 10 to 12, is configured to provide a variable fit gripping action by resilient inward and outward movement of the clamp member sidewalls. Accordingly, a clamp member 212 is shown (which comprises one of a pair of the clamp members of the present fastener attachment) which includes a front wall 214, a pair of integral laterally spaced sidewalls 216 each having a retaining lip 218, and an integral bottom wall 220. In accordance with the present invention, a rectangular cavity is thereby defined for receiving a respective one of the jaws of a pair of pliers. The clamp member 212 has been illustrated generally in accordance with the configuration of previously described second clamp number 12, and thus is illustrated as including a button-receiving depression 224 defined by bottom wall 220.

In this embodiment of the present invention, variable fit of each of a pair of clamp members is achieved by joining the sidewalls 216 thereof to the front wall 214 with the sidewalls being at least partially separated from the bottom wall, as shown at 225. The sidewalls 216 can be separated from the bottom 220 by providing a gap such as 225 within the body of the sidewalls. The sidewalls 216 are configured to taper toward each other in a direction away from front wall 214, with the nature of the connection of the sidewalls to front wall 214 providing the desired resilient flexibility of the sidewalls so that they grippingly engage the laterally opposite sides of a pliers jaw received therebetween. As with the previously described embodiment of FIGS. 10–12, the tapering configuration of walls 216 can be readily achieved by injection molding the clamp member, with the sidewalls in substantially parallel relation, whereupon removal from the mold the sidewalls take on their inwardly tapering configuration as the clamp member cools and cures.

Thus, a fastener-applying attachment is disclosed which comprises a pair of clamp members each configured for variable fit on the respective jaws of a pair of pliers. As noted above, the clamp members may be formed from many different materials, with the exact configurations of their clamping faces depending upon the type of fastener assembly to be applied. While three different embodiments of the present invention have been disclosed, it is to be understood that features of the different embodiments can be combined in keeping with the teachings herein. For example, each clamp member of the attachment can be provided with a pair of gripping fins 26 with the desired variable fit further achieved by configuring the sidewalls of the clamp member for resilient inward and outward movement such as in the embodiments of FIGS. 10–15. While the present invention has been disclosed in forms to facilitate application of clamping pressure to an associated fastener assembly, it will be recognized that a pliers attachment embodying the principles disclosed herein can readily be provided for effecting crimping, hole punching, or like material working on an associated structure.

From the foregoing, it will be observed that numerous modifications and variations of the present invention can be effected without departing from the true spirit and scope of the novel concept of the present invention. It is to be understood that no limitation with respect to the specific embodiments shown is intended or should be inferred. It is, of course, intended to cover by the intended claims all such modifications as followed in the scope of the claims.

What is claimed:

1. A variable fit fastener attachment for a pair of pliers having jaws, comprising:

a pair of first and second fastener clamp means each including a bottom wall, a front wall, and a pair of laterally spaced sidewalls which together define a generally rectangular cavity for receiving a respective one of the jaws of said pliers whereby said first and second clamp means are adapted for removable fitment to said pliers jaws in generally opposed relation for applying clamping pressure to an associated fastener assembly positioned therebetween, each of said first and second clamp means including variable fit means to permit fitment of said clamp means to different pairs of pliers having differently sized jaws, said variable fit means of each said clamp means comprising a pair of flexible gripping fins extending integrally inwardly of said cavity from respective ones of said sidewalls generally from respective junction of said sidewalls and said bottom wall, each of said gripping fins decreasing in thickness from its respective one of said sidewalls to a free edge thereof.

2. A variable fit fastener attachment in accordance with claim 1, wherein said pair of gripping fins taper toward each other from said open end of said cavity to said front wall.

3. A variable fit fastener attachment in accordance with claim 2, wherein at least one of said first clamp and second means includes anvil means extending through its bottom wall for applying clamping pressure to said associated fastener assembly.

4. A variable fit fastener attachment in accordance with claim 1, wherein each of said sidewalls of each said clamp means is joined to said bottom wall and is at least partially separated from said front wall to accomodate resilient inward and outward movement of said sidewalls to provide said variable fit means, said sidewalls tapering toward each other in a direction away from said bottom wall.

5. A variable fit fastener attachment in accordance with claim 1, wherein each of said sidewalls of each said clamp means is joined to said front wall and is at least partially separated from said bottom wall to accomodate resilient inward and outward movement of said sidewalls to provide said variable fit means, side sidewalls tapering toward each other in a direction away from said front wall.

6. A variable fit fastener attachment in accordance with claim 1, wherein the inner opposed surfaces of said sidewalls taper toward each other in a direction away from said bottom wall.

7. A variable fit fastener attachment for a pair of plier having jaws, comprising:

a pair of first and second fastener clamp means each defining a generally rectangular cavity for receiving a respective one of the jaws of said pliers whereby said first and second clamp means are adapted for removable fitment to said pliers jaws in generally opposed relation for applying clamping pressure to an associated structure positioned therebetween, each of said first and second clamp means comprising a bottom wall, a front wall, and a pair of laterally spaced sidewalls which together define said generally rectangular cavity with an open end, each of said first and second clamp means including variable fit means to permit fitment of said clamp means to different pairs of pliers having differently sized jaws, said variable fit means of each of said first and second clamp means comprising flexible gripping means extending into the cavity of each of said clamp means comprising a pair of gripping fin means extending into said cavity from respective lateral sides thereof configured for respective engagement with generally laterally opposite sides of said respective pliers jaw, each said gripping fin means extending inwardly of said cavity generally from a respective one said sidewalls.

8. A variable fit fastener attachment in accordance with claim 7, wherein said pair of gripping fin means taper toward each other generally from said open end to said front wall.

9. A variable fit fastener attachment in accordance with claim 7, wherein each of said pair of gripping fin means decreases in thickness from its respective one of said sidewalls to a free edge thereof.

10. A variable fit fastener attachment in accordance with claim 7, wherein each of said first and second clamp means comprises a bottom wall, a front wall, and a pair of laterally spaced sidewalls which together define said generally rectangular cavity with an open end, said variable fit means comprising means for accomodating resilient inward and outward movement of said sidewalls.

11. A variable fit fastener attachment in accordance with claim 10, wherein each of said sidewalls is joined to said bottom wall and each of said sidewalls is at least partially separated from said front wall to provide said resilient movement means.

12. A variable fit fastener attachment in accordance with claim 10, wherein each of said sidewalls is joined to said front wall and each of said sidewalls is at least partially separated from said bottom wall to provide said resilient movement means.

13. A variable fit fastener attachment in accordance with claim 7, wherein the inner opposed surfaces of said sidewalls taper toward each other in a direction away from said bottom wall.

* * * * *